US005257876A

United States Patent [19]

Takahashi et al.

[11] Patent Number: 5,257,876

[45] Date of Patent: Nov. 2, 1993

[54] METHOD FOR CONSTRUCTING ASPHALTED ROAD HAVING HEATING PIPE LAID THEREUNDER

[75] Inventors: Kiyoshi Takahashi; Takeo Fukuda, both of Ibaraki, Japan

[73] Assignee: Mitsubishi Yuka Industrial Products Corporation, Tokyo, Japan

[21] Appl. No.: 800,043

[22] Filed: Nov. 29, 1991

[30] Foreign Application Priority Data

Nov. 29, 1990 [JP] Japan ..... 2-325332
Mar. 15, 1991 [JP] Japan ..... 3-128812

[51] Int. Cl.[5] ..... E01C 7/06; E01C 23/14

[52] U.S. Cl. ..... 404/77; 404/79; 404/95

[58] Field of Search ..... 404/71, 75, 77, 79, 404/17, 27, 28, 95; 126/271.1

[56] References Cited

U.S. PATENT DOCUMENTS 3,367,892 2/1968 Jorczak et al. ..... 404/77 X
4,305,681 12/1981 Backlund ..... 404/95
4,815,891 3/1989 O'Conner ..... 404/77

*Primary Examiner*—Kenneth J. Dorner
*Assistant Examiner*—Nancy P. Connolly
*Attorney, Agent, or Firm*—Oblon, Spivak, McClelland, Maier & Neustadt

[57] ABSTRACT

A method for constructing an asphalted road having a heating pipe laid thereunder, which comprises laying wire netting on a roadbed, placing a heating plastic pipe on the wire netting, fixing the pipe thereto and depositing asphalt concrete thereon, characterized by that a cooling medium is allowed to flow in the plastic pipe laid on the roadbed, and asphalt concrete is deposited while the inside of the plastic pipe is kept under a pressurized condition of 0.05 to 5 kg/cm$^2$ by the cooling medium.

7 Claims, 2 Drawing Sheets

METHOD FOR CONSTRUCTING ASPHALTED ROAD HAVING HEATING PIPE LAID THEREUNDER

FIELD OF THE INVENTION

This invention relates to a method for constructing an asphalted road under which a heating plastic pipe is laid to thereby prevent roads from being snowed up or frozen. More particularly, it relates to an improved method for constructing an asphalted road which is freed from the problem in that a heating plastic pipe previously laid on a roadbed is crushed during pavement works comprising depositing asphalt concrete which is heated at a high temperature and fed.

BACKGROUND OF THE INVENTION

In the construction of an asphalted road, under which a plastic pipe is laid, on a roadbed to prevent a road from being snowed up or frozen, there is used a method wherein wire netting is first laid on a roadbed, a plastic pipe is laid on and fixed to the wire netting, asphalt concrete heated to 150° to 220° C. is fed from an asphalt finisher onto the roadbed and leveled to thereby bury the plastic pipe in the asphalt concrete, and the formed asphalt concrete layer is rolled with a roller under a load of 10 to 20 tons.

The pipes of plastics such as crosslinked polyethylene and nylon are used as the heating plastic pipes.

In the construction of an asphalted road having a heating plastic pipe laid thereunder in the manner as mentioned above, there are caused disadvantages that the plastic pipe is softened by the heat of asphalt concrete fed onto the roadbed and waves by thermal expansion, or the softened plastic pipe is crushed or deformed by a rolling load when the asphalt concrete layer is leveled with a roller, and the pipe becomes unusable.

To solve the problems, there has been proposed an construction method wherein when asphalt heated at a high temperature is deposited, a cooling medium is allowed to flow through the plastic pipe previously laid on the roadbed to thereby prevent the above-mentioned disadvantages from being caused, for example, to prevent the plastic pipe from waving by thermal expansion or prevent the plastic pipe from being softened and crushed during pavement works comprising depositing asphalt [see, JP-B-52-40133 (The term "JP-B" as used herein means an "Examined Japanese Patent Publication")].

In the above construction method wherein the pipe is cooled with a cooling medium, the waving by thermal expansion or crushing can be prevented to some degree when a pipe of a plastic material having a high softening temperature such as nylon is used. However, when a pipe of a plastic material having a low softening temperature such as crosslinked polyethylene is used, an effect of preventing the pipe from being softened and crushed is insufficient.

This invention has been accomplished with the view of solving the problems associated with the prior art as mentioned above.

SUMMARY OF THE INVENTION

Accordingly, an object of the present invention is to provide an improved method for constructing an asphalted road having a heating plastic pipe laid thereunder which is freed from the above-mentioned problem in that the plastic pipe laid is deformed, wherein the inside of the plastic pipe previously laid on a roadbed is kept under predetermined pressurized conditions by a cooling medium allowed to flow in the plastic pipe, and preferably the deposition work of asphalt concrete is carried out by a two-step process comprising in the first step, carrying out preliminary rolling by a rolling load which is as low as possible.

The above-described object of the present invention has been achieved by providing a method for constructing an asphalted road having a heating pipe laid thereunder, which comprises laying wire netting on a roadbed, placing a heating plastic pipe on the wire netting, fixing the plastic pipe thereto and depositing asphalt concrete thereon, characterized in that a cooling medium is allowed to flow in the plastic pipe laid on the roadbed and asphalt concrete is deposited while the inside of the plastic pipe is kept under a pressurized condition of 0.05 to 5 kg/cm$^2$ by the cooling medium.

In a preferred embodiment of the present invention, asphalt concrete is fed onto a roadbed and leveled so as to allow a plastic pipe to be buried therein, the resulting lower layer of asphalt concrete is preliminarily rolled under a load of 1 to 5 tons and then under a normal load of 10 to 20 tons, further asphalt concrete is fed onto the lower layer of asphalt concrete, leveled and the resulting upper layer of asphalt concrete is then rolled under a normal load of 10 to 20 tons.

Since the inside of the plastic pipe is pressurized by the cooling medium allowed to flow therein, the plastic pipe can be prevented from being softened and deformed, and hence there can be solved the problem that the plastic pipe is crushed during pavement work comprising depositing heated asphalt concrete.

Figure 1:
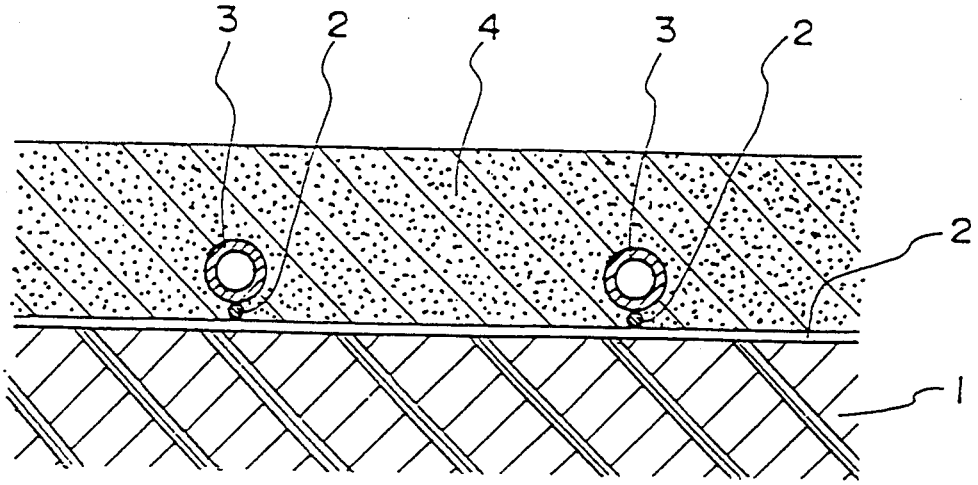
FIG. 1 is a cross-sectional view of a paved road showing an embodiment of the present invention.

In the drawings, numerals represent the following members:

1: Roadbed,
2: Wire netting,
3: Plastic pipe,
4: Asphalt concrete layer,
5: Lower layer of asphalt concrete,
6: Upper layer of asphalt concrete.

DETAILED DESCRIPTION OF THE INVENTION

The present invention is illustrated in more detail below by referring to the accompanying drawings.

Referring to FIG. 1, a roadbed 1 is developed by covering the leveled ground with pebbles and sand, rolling the ground and spreading leveling asphalt concrete thereover. The present invention is conducted by that in laying a heating plastic pipe 3 between the roadbed 1 and an asphalt concrete layer 4 to be deposited on the roadbed 1, a cooling medium is allowed to flow in the plastic pipe 3 laid on the roadbed 1 by being fixed to lattice-form welded wire netting 2, and asphalt concrete is deposited while the inside of the plastic pipe is kept under a pressure of 0.05 to 5 kg/cm$^2$, preferably 0.5 to 3 kg/cm$^2$ by the cooling medium.

Examples of the plastic pipe 3 which can be used in the present invention include pipes having an inner diameter of 10 to 30 mm and a wall thickness of 1 to 3 mm, made of crosslinked polyethylene or nylon. Examples of the cooling medium which can be used in the present invention include water, mixed solution of water and an antifreeze and air. Examples of asphalt concrete which can be used in the present invention include coarse-grained asphalt concrete, fine-grained asphalt concrete and a mixture thereof. When pressure with the cooling medium is less than 0.05 kg/cm$^2$, the plastic pipe can not be prevented from being crushed, while when pressure is higher than 5 kg/cm$^2$, the plastic pipe heavily waves, and the pipe is sometimes bursted. A valve is provided on the side of the outlet of the plastic pipe 3, and the internal pressure of the pipe is kept in a predetermined range by completely closing the valve or controlling the opening of the valve.

The asphalt concrete layer 4 of FIG. 1 is formed by a two-step process in the following manner.

Figure 2:
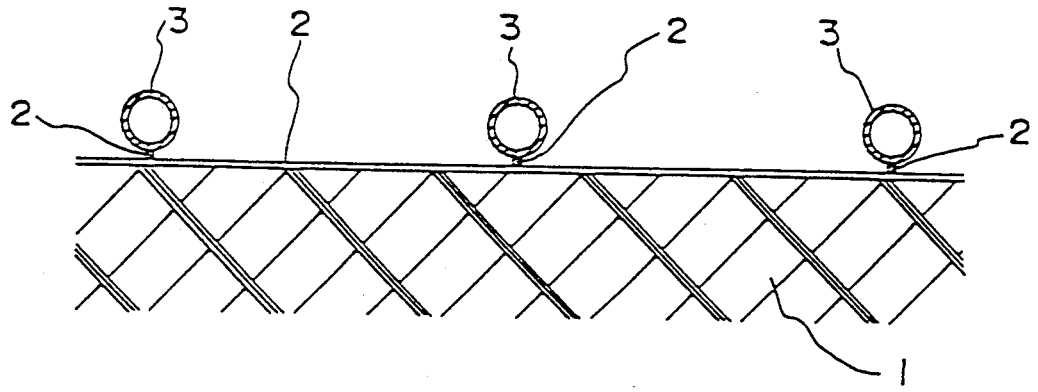
FIG. 2 is a cross-sectional view showing the early stage of an another embodiment of the present invention.
Figure 3:
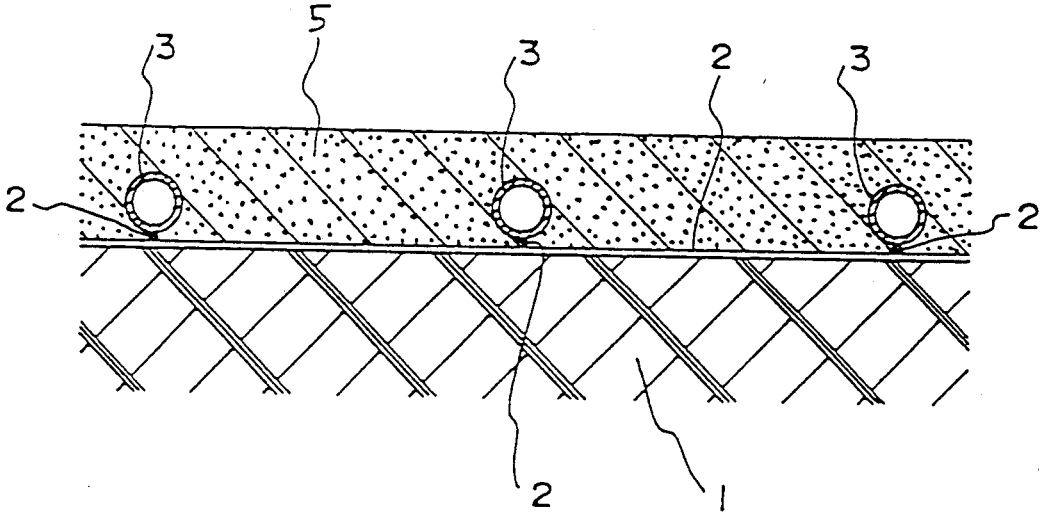
FIG. 3 is a cross-sectional view showing the intermediate stage of the said embodiment of the present invention.

First, the lattice-form welded wire netting 2 is laid on the roadbed 1, and the plastic pipe 3 is placed in a zigzag form on the wire netting and fixed thereto as shown in FIG. 2. Second, coarse-grained asphalt concrete is spread thereover, the formed lower layer of asphalt concrete 5 is rolled under a rolling load of 1 to 5 tons by using an appropriate rolling machine (primary preliminary rolling step), and the layer is then rolled under a rolling load of 10 to 20 tons by using macadam roller and/or tyre roller (primary rolling step) as shown in FIG. 3.

Figure 4:
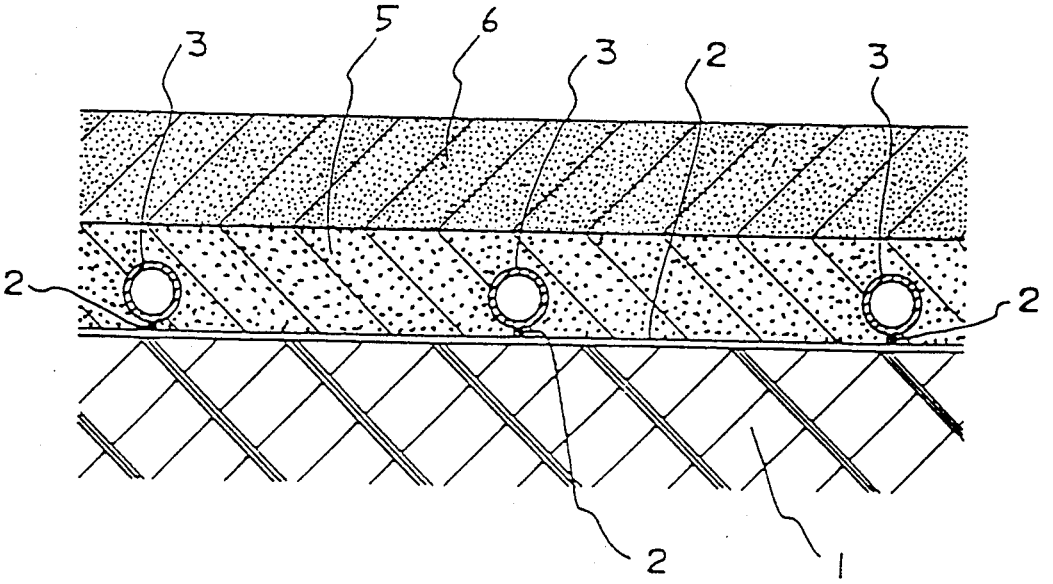
FIG. 4 is a cross-sectional view showing the final stage of the said embodiment of the present invention.

Finally, after the lower layer of asphalt concrete 5 is sufficiently cooled, fine-grained asphalt concrete is spread all over the lower layer of asphalt concrete 5 by using an asphalt finisher, and the formed upper layer of asphalt concrete 6 is rolled under a rolling load of 10 to 20 tons by using macadam roller and/or tyre roller (secondary rolling step) as shown in FIG. 4.

In this way, pavement work is completed to develop a road.

In this case, it is preferred that the work for spreading coarse-grained asphalt concrete in the primary rolling step is carried out by means of a hand method by using such as a scoop to protect the plastic pipe 3. However, when there is no fear of damaging the plastic pipe 3, any of appropriate rolling machines may be used.

The reason why the preliminary rolling of the lower layer of asphalt concrete is carried out under a load of 1 to 5 tons is that when the load exceeds 5 tons, there are posed problems that the heating plastic pipe is liable to be deformed, a heating medium is no longer allowed to flow by increasing a resistance to running medium, or the physical properties of the pipe are lowered, while when the load is less than 1 ton, a rolling effect can not be obtained.

The present invention is now illustrated in greater detail by reference to the following examples which, however, are not to be construed as limiting the present invention in any way.

EXAMPLE

Lattice-form welded wire netting was laid on a roadbed of 4 m in width. Crosslinked polyethylene pipe having an inner diameter of 13 mm and a wall thickness of 2 mm was placed thereon in a zigzag form at intervals of 150 mm and fixed to the wire netting. Asphalt concrete heated to 180° C. was deposited thereon and leveled under a load of 10 tons by means of an asphalt finisher to form an asphalt concrete layer of 80 mm in thickness. While tap water at 20° C. was allowed to flow through the pipe during the above pavement work, the inside of the pipe was kept under a pressurized condition of 0.8 kg/cm$^2$ (Example I) or 3.0 kg/cm$^2$ (Example II). After the paved road was built in the manner described above, the asphalt layer was peeled off, and the deformation of the pipe was measured. The results are shown in the following Table. The deformation, that is, flatness E of the pipe was determined by the following formula:

$$E\,(\%) = \left(b - a/\frac{a+b}{2}\right) \times 100$$

wherein "E" represents flatness; "a" represents the minor axis when the pipe having a circular section is deformed into an oval; and "b" represents the line of apsides.

For the purpose of comparison, the inner pressure of the pipe was kept at 0 kg/cm$^2$ (Comparative Example I) or 6.0 kg/cm$^2$ (Comparative Example II).

Asphalted road was constructed in the same manner as in Example II except that in the first step, coarse-grained asphalt concrete was spread and the formed lower layer of asphalt concrete was preliminarily rolled under a load of 3 tons and then rolled under a load of 10 tons, and in the subsequent second step, fine-grained asphalt concrete was spread over the lower layer of asphalt concrete and the formed upper layer of asphalt concrete was rolled under a load of 15 tons, in stead of depositing asphalt concrete and leveling it under a load of 10 tons (Example III).

TABLE

| | Inner pressure (kg/cm$^2$) | Flatness E (%) | Remarks |
|---|---|---|---|
| Example I | 0.8 | 4.9 | |
| Example II | 3.0 | 3.1 | |
| Comp. Ex. I | 0 | 15.2 | Unusable |
| Comp. Ex. II | 6.0 | | Pipe was crushed |
| Example III | 3.0 | 1.7 | |

According to the present invention, the inside of the plastic pipe is kept under predetermined pressurized conditions by the cooling medium so that there is no fear that the plastic pipe is crushed by the load of a leveling roller even when asphalt concrete heated at a high temperature (150° to 220° C.) is deposited during the course of the construction of an asphalted road.

In addition, the deposition work of asphalt concrete is carried out by a two-step process comprising in the first step, preliminary rolling is carried out by a load which is low as much as possible so that the undesirable physical deterioration or deformation of the plastic pipe can be prevented. Accordingly, the heating pipe can be used without any trouble after the completion of the construction of the road. Further, the effect obtained by the method of the present invention is remarkable when a pipe of a plastic material having a relatively low softening temperature such as crosslinked polyethylene is used.

While the present invention has been described in detail and with reference to specific embodiments thereof, it is apparent to one skilled in the art that various changes and modifications can be made therein without departing from the spirit and scope of the present invention.

We claim:

1. A method for constructing an asphalted road having a heating pipe laid thereunder, said method comprising the steps of:

laying wire netting on a roadbed;

placing a heating plastic pipe on the wire netting;

fixing the pipe on the wire netting; and depositing asphalt concrete thereon; wherein:

a cooling medium is allowed to flow in the plastic pipe laid on the roadbed;

placing a heating plastic pipe on the wire netting:

fixing the pipe on the wire netting; and depositing asphalt concrete thereon; wherein:

a cooling medium is allowed to flow in the plastic pipe laid on the roadbed and asphalt concrete is deposited while an inside of the plastic pipe is kept under a pressurized condition of 0.05 to 5 kg/cm$^2$ with said cooling medium by adjusting an opening of a valve provided on an outlet side of the plastic pipe.

2. A method as claimed in claim 1, wherein said cooling medium is a mixed solution of water and an antifreeze.

3. A method as claimed in claim 1, wherein the inner pressure of the plastic pipe is 0.5 to 3 kg/cm$^2$.

4. A method as claimed in claim 1, wherein said plastic pipe is a pipe made of crosslink polyethylene.

5. A method as claimed in claim 1, wherein the deposition work of asphalt concrete is carried out by a two-step process.

6. A method as claimed in claim 5, wherein coarse-grained asphalt concrete is deposited in the first step, and fine-grained asphalt concrete is deposited in the second step.

7. A method as claimed in claim 6, wherein in the first step, asphalt concrete is spread and the formed lower layer of asphalt concrete is preliminarily rolled under a load of 1 to 5 tons and then rolled under normal load of 10 to 20 tons, and in the subsequent second step, asphalt concrete is spread over the lower layer of asphalt concrete and the formed upper layer of asphalt concrete is rolled under a load of 10 to 20 tons.

* * * * *